US006207634B1

(12) United States Patent
Meyer et al.

(10) Patent No.: US 6,207,634 B1
(45) Date of Patent: Mar. 27, 2001

(54) NON-AQUEOUS, PARTICULATE-CONTAINING DETERGENT COMPOSITIONS CONTAINING BLEACH

(75) Inventors: Axel Meyer, Newcastle upon Tyne (GB); Steven Jozef Louis Coosemans, Kampenhout (BE); Jean-Pol Boutique, Gembloux (BE); James Pyott Johnston, Merchem (BE); Diane Parry, Cincinnati; David Michael Wise, Harrisson, both of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/445,924

(22) PCT Filed: Jun. 25, 1998

(86) PCT No.: PCT/US98/13321

§ 371 Date: Apr. 19, 2000

§ 102(e) Date: Apr. 19, 2000

(87) PCT Pub. No.: WO99/00482

PCT Pub. Date: Jan. 7, 1999

Related U.S. Application Data

(60) Provisional application No. 60/051,092, filed on Jun. 27, 1997.

(51) Int. Cl.[7] ..... C11D 3/00; C11D 3/395; C11D 7/18; C11D 7/54

(52) U.S. Cl. ..... 510/371; 510/372; 510/376

(58) Field of Search ..... 510/367, 371, 510/372, 376, 378; 252/186.38

(56) References Cited

U.S. PATENT DOCUMENTS 4,988,462 * 1/1991 Schepers et al. ..... 252/174.22

FOREIGN PATENT DOCUMENTS

| | | | |
|---|---|---|---|
| 0 339 995 A2 | 11/1989 | (EP) | C11D/3/39 |
| 0 340 001 A2 | 11/1989 | (EP) | C11D/3/39 |
| 0 738 778 A1 | 10/1996 | (EP) | C11D/17/00 |
| WO 92/09678 | 6/1992 | (WO) | C11D/17/00 |
| WO 98/00508 | 1/1998 | (WO) | C11D/17/00 |
| WO 98/00509 | 1/1998 | (WO) | C11D/17/00 |
| WO 98/00510 | 1/1998 | (WO) | C11D/17/00 |
| WO 98/00515 | 1/1998 | (WO) | C11D/17/00 |
| WO 98/00518 | 1/1998 | (WO) | C11D/17/00 |

* cited by examiner

*Primary Examiner*—Yogendra Gupta
*Assistant Examiner*—John M. Petruncio
(74) *Attorney, Agent, or Firm*—C. Brant Cook; Kim William Zerby; Steven W. Miller

(57) ABSTRACT

A non-aqueous liquid detergent composition comprising a bleaching agent and/or bleach precursor characterized in that said nonaqueous liquid detergent comprises less than 1% of free water.

3 Claims, No Drawings

NON-AQUEOUS, PARTICULATE-CONTAINING DETERGENT COMPOSITIONS CONTAINING BLEACH

This application is a 371 of PCT/US98/13321 filed Jun. 25, 1998, which claim benefit of Provisional No. 60/051,092 filed Jun. 27, 1997.

FIELD OF THE INVENTION

This invention relates to non-aqueous laundry detergent products which are in the form of a liquid and which are in the form of stable dispersions of particulate material such as bleaching agents and/or bleach precursor.

BACKGROUND OF THE INVENTION

Detergent products in the form of liquid are often considered to be more convenient to use than are dry powdered or particulate detergent products. Said detergents have therefore found substantial favor with consumers. Such detergent products are readily measurable, speedily dissolved in the wash water, capable of being easily applied in concentrated solutions or dispersions to soiled areas on garments to be laundered and are non-dusting. They also usually occupy less storage space than granular products. Additionally, such detergents may have incorporated in their formulations materials which could not withstand drying operations without deterioration, operations which are often employed in the manufacture of particulate or granular detergent products.

Although said detergents have a number of advantages over granular detergent products, they also inherently possess several disadvantages. In particular, detergent composition components which may be compatible with each other in granular products may tend to interact or react with each other. Thus such components as enzymes, surfactants, perfumes, brighteners, solvents and especially bleaches and bleach activators can be especially difficult to incorporate into liquid detergent products which have an acceptable degree of chemical stability.

One approach for enhancing the chemical compatibility of detergent composition components in detergent products has been to formulate non-aqueous (or anhydrous) detergent compositions. In such non-aqueous products, at least some of the normally solid detergent composition components tend to remain insoluble in the liquid product and hence are less reactive with each other than if they had been dissolved in the liquid matrix. Non-aqueous liquid detergent compositions, including those which contain reactive materials such as peroxygen bleaching agents, have been disclosed for example, in Hepworth et al., U.S. Pat. No. 4,615,820, Issued Oct. 17, 1986; Schultz et al., U.S. Pat. No. 4,929,380, Issued May 29, 1990; Schultz et al., U.S. Pat. No. 5,008,031, Issued Apr. 16, 1991; Elder et al., EP-A-030,096, Published Jun. 10, 1981; Hall et al., WO 92/09678, Published Jun. 11, 1992 and Sanderson et al., EP-A-565,017, Published Oct. 13, 1993.

A particular problem that has been observed with the incorporation of bleach precursors in non-aqueous detergents, includes the chemical stability of the bleach and bleach precursor. Bleach and bleach precursors should remain chemically stable in the concentrate, while rapidly reacting with each other upon dilution in the wash liquor. EP 339 995 describes a non-aqueous liquid detergent composition comprising a persalt bleach and a bleach precursor, the composition containing a capped alkoxylated nonionic surfactant. EP 540 090 proposes to use a bleach precursor which is relatively insoluble in the non-aqueous liquid phase of the liquid detergent composition.

Given the foregoing, there is clearly a continuing need to identify and provide non-aqueous, bleach precursor containing detergent compositions in the form of liquid products that have a high degree of chemical stability in the concentrate along with an efficient bleaching performance in the wash liquor.

Accordingly, it is an object of the present invention to provide a non-aqueous detergent composition wherein the bleach precursors have improved chemical stability in the concentrate, while at the same time still being effective as bleach species in the wash liquor.

According to the present invention, there is provided a liquid non-aqueous detergent composition which is in the form of a liquid, containing a bleaching agent and/or a bleach precursor characterized in that the free water content of said liquid non-aqueous detergent composition is less than 1%, more preferably less than 0.7%.

SUMMARY OF THE INVENTION

The present invention provides a liquid non-aqueous heavy-duty detergent composition, said composition comprising a bleaching agent and a bleach precursor characterized in that the free water content of said liquid non-aqueous detergent composition is less than 1%.

DETAILED DESCRIPTION OF THE INVENTION

The particulate-containing liquid detergent compositions of this invention are substantially non-aqueous (or anhydrous) in character. According to the present invention, it has been found that improved chemical stability of the bleach activator is obtained in case the free water content of the non-aqueous liquid detergent is below 1% by weight in the liquid part of the composition. Free water as used herein means the water that remains in the liquid phase after separation of the solids by means of a centrifuge or filtration techniques. The amount of free water can be measured, for example, by Karl Fischer titration of the clear liquid after centrifugation of the solid material.

Total water content as used herein means the total amount of the free water and the bound water. Total amount of water can also be measured by Karl Fischer titration, if needed after anhydrous methanol extraction.

Without wishing to be bound by theory, it is believed that the free water is available to dissolve compounds such as bleach activators or to release hydrogen peroxide from the bleach source, thereby chemically destabilizing the bleach precursor and/or the bleaching agent.

Bleach source

An essential component of the invention is a bleach precursor and/or a bleaching agent.

Bleach precursors for inclusion in the composition in accordance with the invention typically contain one or more N- or O- acyl groups, which precursors can be selected from a wide range of classes. Suitable classes include anhydrides, esters, imides, nitriles and acylated derivatives of imidazoles and oximes, and examples of useful materials within these classes are disclosed in GB-A-1 586789.

Suitable esters are disclosed in GB-A-836988, 864798, 1147871, 2143231 and EP-A-0170386. The acylation products of sorbitol, glucose and all saccharides with benzoylating agents and acetylating agents are also suitable.

Specific O-acylated precursor compounds include 3,5,5-tri-methyl hexanoyl oxybenzene sulfonates, benzoyl oxybenzene sulfonates, cationic derivatives of the benzoyl oxybenzene sulfonates, nonanoyl-6-amino caproyl oxybenzene sulfonates, monobenzoyltetraacetyl glucose and pentaacetyl glucose. Phthalic anhydride is a suitable anhydride type precursor. Useful N-acyl compounds are disclosed in GB-A-855735, 907356 and GB-A-1246338.

Preferred precursor compounds of the imide type include N-benzoyl succinimide, tetrabenzoyl ethylene diamine, N-benzoyl substituted ureas and the N,N-N'N' tetra acetylated alkylene diamines wherein the alkylene group contains from 1 to 6 carbon atoms, particularly those compounds in which the alkylene group contains 1, 2 and 6 carbon atoms. A most preferred precursor compound is N,N-N',N' tetra acetyl ethylene diamine (TAED).

N-acylated precursor compounds of the lactam class are disclosed generally in GB-A-955735. Whilst the broadest aspect of the invention contemplates the use of any lactam useful as a peroxyacid precursor, preferred materials comprise the caprolactams and valerolactams.

Suitable caprolactam bleach precursors are of the formula:

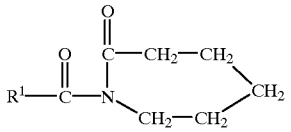

wherein $R^1$ is H or an alkyl, aryl, alkoxyaryl or alkaryl group containing from 1 to 12 carbon atoms, preferably from 6 to 12 carbon atoms.

Suitable valero lactams have the formula:

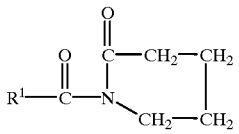

wherein $R^1$ is H or an alkyl, aryl, alkoxyaryl or alkaryl group containing from 1 to 12 carbon atoms, preferably from 6 to 12 carbon atoms. In highly preferred embodiments, $R^1$ is selected from phenyl, heptyl, octyl, nonyl, 2,4,4-trimethylpentyl, decenyl and mixtures thereof.

Other suitable materials are those which are normally solid at <30° C., particularly the phenyl derivatives, ie. benzoyl valerolactam, benzoyl caprolactam and their substituted benzoyl analogues such as chioro, amino, nitro, alkyl, alkyl, aryl and alkyoxy derivatives.

Caprolactam and valerolactam precursor materials wherein the $R^1$ moiety contains at least 6, preferably from 6 to about 12, carbon atoms provide peroxyacids on perhydrolysis of a hydrophobic character which afford nucleophilic and body soil clean-up. Precursor compounds wherein $R^1$ comprises from 1 to 6 carbon atoms provide hydrophilic bleaching species which are particularly efficient for bleaching beverage stains.

Mixtures of 'hydrophobic' and 'hydrophilic' caprolactams and valero lactams, typically at weight ratios of 1:5 to 5:1, preferably 1:1, can be used herein for mixed stain removal benefits.

Another preferred class of bleach precursor materials include the cationic bleach activators, derived from the valerolactam and acyl caprolactam compounds, of formula:

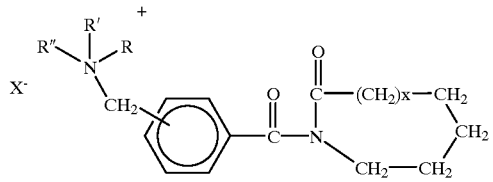

wherein x is 0 or 1, substituents R, R' and R" are each C1–C10 alkyl or C2–C4 hydroxy alkyl groups, or $[(C_yH_{2y})O]_n^-R'''$ wherein y=2–4, n=1–20 and R''' is a C1–C4 alkyl group or hydrogen and X is an anion.

Suitable imidazoles include N-benzoyl imidazole and N-benzoyl benzimidazole and other useful N-acyl group-containing peroxyacid precursors include N-benzoyl pyrrolidone, dibenzoyl taurine and benzoyl pyroglutamic acid.

Another preferred class of bleach activator compounds are the amide substituted compounds of the following general formulae:

$$R^1N(R^5)C(O)R^2C(O)L \text{ or } R^1C(O)N(R^5)R^2C(O)L$$

wherein $R^1$ is an alkyl, alkylene, aryl or alkaryl group with from about 1 to about 14 carbon atoms, $R^2$ is an alkylene, arylene, and alkarylene group containing from about 1 to 14 carbon atoms, and $R^5$ is H or an alkyl, aryl, or alkaryl group containing 1 to 10 carbon atoms and L can be essentially any leaving group. $R^1$ preferably contains from about 6 to 12 carbon atoms. $R^2$ preferably contains from about 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should preferably not contain more than 18 carbon atoms total. Preferred examples of bleach precursors of the above formulae include amide substituted peroxyacid precursor compounds selected from (6-octanamido-caproyl) oxybenzenesulfonate, (6-nonana midocaproyl)oxy benzene sulfonate, (6-decanamido-caproyl) oxybenzene-sulfonate, and mixtures thereof as described in EP-A-0170386.

Also suitable are precursor compounds of the benzoxazin-type, as disclosed for example in EP-A-332,294 and EP-A-482,807, particularly those having the formula:

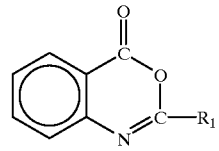

including the substituted benzoxazins of the type

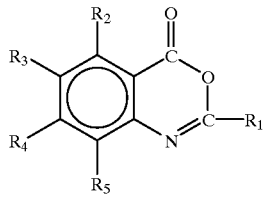

wherein $R_1$ is H, alkyl, alkaryl, aryl, arylalkyl, secondary or tertiary amines and wherein $R_2$, $R_3$, $R_4$, and $R_5$ may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

A precurs or of the benzoxazin-type is:

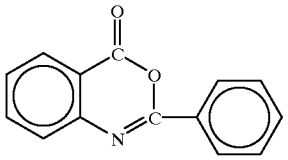

These bleach precursors can be partially replaced by preformed peracids such as N,N phthaloylaminoperoxy acid (PAP), nonyl amide of peroxyadipic acid (NAPAA), 1,2 diperoxydodecanedioic acid (DPDA) and trimethyl ammonium propenyl imidoperoxy mellitic acid (TAPIMA).

Most preferred among the above described bleach precursors are the amide substituted bleach precursor compounds. Most preferably, the bleach precursors are the amide substituted bleach precursor compounds selected from (6-octanamido-caproyl)oxybenzenesulfonate, (6-nonanamidocaproyl)oxy benzene sulfonate, (6-decanamido-caproyl)oxybenzenesulfonate, and mixtures thereof.

The bleach precursor may be in any known suitable particulate form for incorporation in a detergent composition, such as agglomerate, granule, extrudate or spheronised extrudate. Preferably, the bleach precursor is in a form of a spheronised extrudate.

Preferred bleaching agents are solid sources of hydrogen peroxide.

Preferred sources of hydrogen peroxide include perhydrate bleaches. The perhydrate is typically an inorganic perhydrate bleach, normally in the form of the sodium salt, as the source of alkaline hydrogen peroxide in the wash liquor. This perhydrate is normally incorporated at a level of from 0.1% to 60%, preferably from 3% to 40% by weight, more preferably from 5% to 35% by weight and most preferably from 8% to 30% by weight of the composition.

The perhydrate may be any of the alkalimetal inorganic salts such as perborate monohydrate or tetrahydrate, percarbonate, perphosphate and persilicate salts but is conventionally an alkali metal perborate or percarbonate.

Sodium percarbonate, which is the preferred perhydrate, is an addition compound having a formula corresponding to 2Na2CO3.3H2O2, and is available commercially as a crystalline solid. Most commercially available material includes a low level of a heavy metal sequestrant such as EDTA, 1-hydroxyethylidene 1, 1-diphosphonic acid (HEDP) or an amino-phosphonate, that is incorporated during the manufacturing process. For the purposes of the detergent composition aspect of the present invention, the percarbonate can be incorporated into detergent compositions without additional protection, but preferred executions of such compositions utilise a coated form of the material. A variety of coatings can be used including borate, boric acid and citrate or sodium silicate of SiO2:Na2O ratio from 1.6:1 to 3.4:1, preferably 2.8:1, applied as an aqueous solution to give a level of from 2% to 10%, (normally from 3% to 5%) of silicate solids by weight of the percarbonate. However the most preferred coating is a mixture of sodium carbonate and sulphate or sodium chloride.

The particle size range of the crystalline percarbonate is from 350 micrometers to 1500 micrometers with a mean of approximately 500–1000 micrometers.

Surprisingly, it has now been found that bleach precursors have improved chemical stability in the concentrate (the non-aqueous liquid detergent), while at the same time being effective as a bleach species in the wash liquor when present in non-aqueous liquid detergent compositions having a free water content lower than 1%

The non-aqueous detergent compositions of this invention may further comprise a surfactant- and low-polarity solvent containing liquid phase having dispersed therein the bleaching agent and/or the bleach precursor composition. The components of the liquid and solid phases of the detergent compositions herein, as well as composition form, preparation and use, are described in greater detail as follows:

All concentrations and ratios are on a weight basis unless otherwise specified.

Surfactant

The amount of the surfactant mixture component of the non-aqueous liquid detergent compositions herein can vary depending upon the nature and amount of other composition components and depending upon the desired rheological properties of the ultimately formed composition. Generally, this surfactant mixture will be used in an amount comprising from about 10% to 90% by weight of the composition. More preferably, the surfactant mixture will comprise from about 15% to 50% by weight of the composition.

A typical listing of anionic, nonionic, ampholytic and zwitterionic classes, and species of these surfactants, is given in U.S. Pat. No. 3,664,961 issued to Norris on May 23, 1972.

Highly preferred anionic surfactants are the linear alkyl benzene sulfonate (LAS) materials. Such surfactants and their preparation are described for example in U.S. Pat. No. 2,220,099 and 2,477,383, incorporated herein by reference. Especially preferred are the sodium and potassium linear straight chain alkylbenzene sulfonates in which the average number of carbon atoms in the alkyl group is from about 11 to 14. Sodium $C_{11}$–$C_{14}$, e.g., $C_{12}$, LAS is especially preferred.

Preferred anionic surfactants include the alkyl sulfate surfactants hereof are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{18}$ alkyl component, more preferably a $C_{12}$–$C_{15}$ alkyl or hydroxyalkyl, and M is H or a cation, e.g., an alkali metal cation (e.g. sodium, potassium, lithium), or ammonium or substituted ammonium (quatemary ammonium cations such as tetramethyl-ammonium and dimethyl piperdinium cations).

Highly preferred anionic surfactants include alkyl alkoxylated sulfate surfactants hereof are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{18}$ alkyl or hydroxyalkyl, more preferably $C_{12}$–$C_{15}$ alkyl or hydroxyalkyl, A is an ethoxy or propoxy unit, m is greater than zero, typically between about −0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include quaternary ammonium cations such as tetramethyl-ammonium and dimethyl piperdinium cations Exemplary surfactants are $C_{12}$–$C_{15}$ alkyl polyethoxylate (1.0) sulfate ($C_{12}$–$C_{15}$E(1.0)M), $C_{12}$–$C_{15}$ alkyl polyethoxylate (2.25) sulfate ($C_{12}$–$C_{15}$E(2.25)M), $C_{12}$–$C_{15}$ alkyl polyethoxylate (3.0) sulfate ($C_{12}$–$C_{15}$E(3.0)M), and $C_{12}$–$C_{15}$ alkyl polyethoxylate (4.0) sulfate ($C_{12}$–$C_{15}$E(4.0)M), wherein M is conveniently selected from sodium and potassium.

Other suitable anionic surfactants to be used are alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

The preferred alkyl ester sulfonate surfactant, especially for laundry applications, comprise alkyl ester sulfonate surfactants of the structural formula:

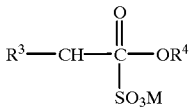

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_6$ alkyl.

Other anionic surfactants useful for detersive purposes can also be included in the laundry detergent compositions of the present invention. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary of secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), sulfates of alkylpolysaccharides such as the sulfates of alkylpolyglucoside (the nonionic nonsulfated compounds being described below), and alkyl polyethoxy carboxylates such as those of the formula $RO(CH_2CH_2)_k$—$CH_2COO$—M+ wherein R is a $C_8$–$C_{22}$ alkyl, k is an integer from 1 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

When included therein, the detergent compositions of the present invention typically comprise from about 1% to about 40%, preferably from about 5% to about 25% by weight of such anionic surfactants.

One class of nonionic surfactants useful in the present invention are condensates of ethylene oxide with a hydrophobic moiety to provide a surfactant having an average hydrophilic-lipophilic balance (HLB) in the range from 8 to 17, preferably from 9.5 to 14, more preferably from 12 to 14. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–12 moles of ethylene oxide per mole of alcohol, particularly the $C_{12}$–$C_{15}$ primary alcohols containing 5–8 moles of ethylene oxide per mole of alcohol.

Another class of nonionic surfactants comprises alkyl polyglucoside compounds of general formula $$RO(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0094 118.

Also suitable as nonionic surfactants are poly hydroxy fatty acid amide surfactants of the formula

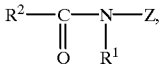

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

Non-aqueous Liquid Diluent

To form the liquid phase of the detergent compositions, the hereinbefore described surfactant (mixture) may be combined with a non-aqueous liquid diluent such as a liquid alcohol alkoxylate material or a non-aqueous, low-polarity organic solvent.

Alcohol Alkoxylates

One component of the liquid diluent suitable to form the compositions herein comprises an alkoxylated fatty alcohol material. Such materials are themselves also nonionic surfactants. Such materials correspond to the general formula:

$$R^1(C_mH_{2m}O)_nOH$$

wherein $R^1$ is a $C_{8-C16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. Preferably also the alkoxylated fatty alcohols will be ethoxylated materials that contain from about 2 to 12 ethylene oxide moieties per molecule, more preferably from about 3 to 10 ethylene oxide moieties per molecule.

The alkoxylated fatty alcohol component of the liquid diluent will frequently have a hydrophilic-lipophilic balance (HLB) which ranges from about 3 to 17. More preferably, the HLB of this material will range from about 6 to 15, most preferably from about 8 to 15.

Examples of fatty alcohol alkoxylates useful as one of the essential components of the non-aqueous liquid diluent in the compositions herein will include those which are made from alcohols of 12 to 15 carbon atoms and which contain about 7 moles of ethylene oxide. Such materials have been commercially marketed under the trade names Neodol 25–7 and Neodol 23–6.5 by Shell Chemical Company. Other useful Neodols include Neodol 1–5, an ethoxylated fatty alcohol averaging 11 carbon atoms in its alkyl chain with about 5 moles of ethylene oxide; Neodol 23–9, an ethoxylated primary $C_{12}$–$C_{13}$ alcohol having about 9 moles of ethylene oxide and Neodol 91–10, an ethoxylated $C_9$–$C_{11}$ primary alcohol having about 10 moles of ethylene oxide. Alcohol ethoxylates of this type have also been marketed by Shell Chemical Company under the Dobanol tradename. Dobanol 91–5 is an ethoxylated $C_9$–$C_{11}$ fatty alcohol with an average of 5 moles ethylene oxide and Dobanol 25–7 is an ethoxylated $C_{12}$–$C_{15}$ fatty alcohol with an average of 7 moles of ethylene oxide per mole of fatty alcohol.

Other examples of suitable ethoxylated alcohols include Tergitol 15-S-7 and Tergitol 15-S-9 both of which are linear secondary alcohol ethoxylates that have been commercially marketed by Union Carbide Corporation. The former is a mixed ethoxylation product of $C_{11}$ to $C_{15}$ linear secondary alkanol with 7 moles of ethylene oxide and the latter is a similar product but with 9 moles of ethylene oxide being reacted.

Other types of alcohol ethoxylates useful in the present compositions are higher molecular weight nonionics, such as Neodol 45–11, which are similar ethylene oxide condensation products of higher fatty alcohols, with the higher fatty alcohol being of 14–15 carbon atoms and the number of ethylene oxide groups per mole being about 11. Such products have also been commercially marketed by Shell Chemical Company.

The alcohol alkoxylate component when utilized as part of the liquid diluent in the non-aqueous compositions herein will generally be present to the extent of from about 1% to 60% by weight of the composition. More preferably, the alcohol alkoxylate component will comprise about 5% to 40% by weight of the compositions herein. Most preferably, the alcohol alkoxylate component will comprise from about 10% to 25% by weight of the detergent compositions herein.

Non-aqueous Low-Polarity Organic Solvent

Another component of the liquid diluent which may form part of the detergent compositions herein comprises non-aqueous, low-polarity organic solvent(s). The term "solvent" is used herein to connote the non-surface active carrier or diluent portion of the liquid phase of the composition. While some of the essential and/or optional components of the compositions herein may actually dissolve in the "solvent"-containing phase, other components will be present as particulate material dispersed within the "solvent"-containing phase. Thus the term "solvent" is not meant to require that the solvent material be capable of actually dissolving all of the detergent composition components added thereto.

The non-aqueous organic materials which are employed as solvents herein are those which are liquids of low polarity. For purposes of this invention, "low-polarity" liquids are those which have little, if any, tendency to dissolve one of the preferred types of particulate material used in the compositions herein, i.e., the peroxygen bleaching agents, sodium perborate or sodium percarbonate. Thus relatively polar solvents such as ethanol should not be utilized. Suitable types of low-polarity solvents useful in the non-aqueous liquid detergent compositions herein do include alkylene glycol mono lower alkyl ethers, lower molecular weight polyethylene glycols, lower molecular weight methyl esters and amides, and the like.

A preferred type of non-aqueous, low-polarity solvent for use herein comprises the mono-, di-, tri-, or tetra- $C_2$–$C_3$ alkylene glycol mono $C_2$–$C_6$ alkyl ethers. The specific examples of such compounds include diethylene glycol monobutyl ether, tetraethylene glycol monobutyl ether, dipropolyene glycol monoethyl ether, and dipropylene glycol monobutyl ether. Diethylene glycol monobutyl ether and dipropylene glycol monobutyl ether are especially preferred. Compounds of the type have been commercially marketed under the tradenames Dowanol, Carbitol, and Cellosolve.

Another preferred type of non-aqueous, low-polarity organic-solvent useful herein comprises the lower molecular weight polyethylene glycols (PEGs). Such materials are those having molecular weights of at least about 150. PEGs of molecular weight ranging from about 200 to 600 are most preferred.

Yet another preferred type of non-polar, non-aqueous solvent comprises lower molecular weight methyl esters. Such materials are those of the general formula: $R^1$—C(O)—$OCH_3$ wherein $R^1$ ranges from 1 to about 18. Examples of suitable lower molecular weight methyl esters include methyl acetate, methyl propionate, methyl octanoate, and methyl dodecanoate.

The non-aqueous, low-polarity organic solvent(s) employed should, of course, be compatible and non-reactive with other composition components, e.g., bleach and/or activators, used in the liquid detergent compositions herein. Such a solvent component will generally be utilized in an amount of from about 1% to 60% by weight of the composition. More preferably, the non-aqueous, low-polarity organic solvent will comprise from about 5% to 40% by weight of the composition, most preferably from about 10% to 25% by weight of the composition.

Liquid Diluent Concentration

As with the concentration of the surfactant mixture, the amount of total liquid diluent in the compositions herein will be determined by the type and amounts of other composition components and by the desired composition properties. Generally, the liquid diluent will comprise from about 20% to 95% by weight of the compositions herein. More preferably, the liquid diluent will comprise from about 50% to 70% by weight of the composition.

SOLID PHASE

The non-aqueous detergent compositions herein may further comprise a solid phase of particulate material which is dispersed and suspended within the liquid phase. Generally such particulate material will range in size from about 0.1 to 1500 microns. More preferably such material will range in size from about 5 to 500 microns.

The particulate material utilized herein can comprise one or more types of detergent composition components which in particulate form are substantially insoluble in the non-aqueous liquid phase of the composition. The types of particulate materials which can be utilized are described in detail as follows:

Surfactants

Another type of particulate material which can be suspended in the non-aqueous liquid detergent compositions herein includes ancillary anionic surfactants which are fully or partially insoluble in the non-aqueous liquid phase. The most common type of anionic surfactant with such solubility properties comprises primary or secondary alkyl sulfate anionic surfactants. Such surfactants are those produced by the sulfation of higher $C_8$–$C_{20}$ fatty alcohols.

Conventional primary alkyl sulfate surfactants have the general formula $$ROSO_3—M^+$$

wherein R is typically a linear $C_8$–$C_{20}$ hydrocarbyl group, which may be straight chain or branched chain, and M is a water-solubilizing cation. Preferably R is a $C_{10}$–$C_{14}$ alkyl, and M is alkali metal. Most preferably R is about $C_{12}$ and M is sodium.

Conventional secondary alkyl sulfates may also be utilized as the essential anionic surfactant component of the solid phase of the compositions herein. Conventional secondary alkyl sulfate surfactants are those materials which have the sulfate moiety distributed randomly along the hydrocarbyl "backbone" of the molecule. Such materials may be depicted by the structure $$CH_3(CH_2)n(CHOSO_3\text{–}M^+)\ (CH_2)_mCH_3$$

wherein m and n are integers of 2 or greater and the sum of m+n is typically about 9 to 15, and M is a water-solubilizing cation.

If utilized as all or part of the requisite particulate material, ancillary anionic surfactants such as alkyl sulfates will generally comprise from about 1% to 10% by weight of the composition, more preferably from about 1 % to 5% by weight of the composition. Alkyl sulfate used as all or part of the particulate material is prepared and added to the compositions herein separately from the unalkoxylated alkyl sulfate material which may form part of the alkyl ether sulfate surfactant component essentially utilized as part of the liquid phase herein.

Organic Builder Material

Another possible type of particulate material which can be suspended in the non-aqueous liquid detergent compositions herein comprises an organic detergent builder material which serves to counteract the effects of calcium, or other ion, water hardness encountered during laundering/bleaching use of the compositions herein. Examples of such materials include the alkali metal, citrates, succinates, malonates, fatty acids, carboxymethyl succinates, carboxylates, polycarboxylates and polyacetyl carboxylates. Specific examples include sodium, potassium and lithium salts of oxydisuccinic acid, mellitic acid, benzene polycarboxylic acids and citric acid. Other examples of organic phosphonate type sequestering agents such as those which have been sold by Monsanto under the Dequest tradename and alkanehydroxy phosphonates. Citrate salts are highly preferred.

Other suitable organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the Sokalan trademark.

Another suitable type of organic builder comprises the water-soluble salts of higher fatty acids, i.e., "soaps". These include alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

If utilized as all or part of the requisite particulate material, insoluble organic detergent builders can generally comprise from about 1 % to 20% by weight of the compositions herein. More preferably, such builder material can comprise from about 4% to 10% by weight of the composition.

Inorganic Alkalinity Sources

Another possible type of particulate material which can be suspended in the non-aqueous liquid detergent compositions herein can comprise a material which serves to render aqueous washing solutions formed from such compositions generally alkaline in nature. Such materials may or may not also act as detergent builders, i.e., as materials which counteract the adverse effect of water hardness on detergency performance.

Examples of suitable alkalinity sources include water-soluble alkali metal carbonates, bicarbonates, borates, silicates and metasilicates. Although not preferred for ecological reasons, water-soluble phosphate salts may also be utilized as alkalinity sources. These include alkali metal pyrophosphates, orthophosphates, polyphosphates and phosphonates. Of all of these alkalinity sources, alkali metal carbonates such as sodium carbonate are the most preferred.

The alkalinity source, if in the form of a hydratable salt, may also serve as a desiccant in the non-aqueous liquid detergent compositions herein. The presence of an alkalinity source which is also a desiccant may provide benefits in terms of chemically stabilizing those composition components such as the peroxygen bleaching agent which may be susceptible to deactivation by water.

If utilized as all or part of the particulate material component, the alkalinity source will generally comprise from about 1% to 15% by weight of the compositions herein. More preferably, the alkalinity source can comprise from about 2% to 10% by weight of the composition. Such materials, while water-soluble, will generally be insoluble in the non-aqueous detergent compositions herein. Thus such materials will generally be dispersed in the non-aqueous liquid phase in the form of discrete particles.

OPTIONAL COMPOSITION COMPONENTS

In addition to the composition liquid and solid phase components as hereinbefore described, the detergent compositions herein can, and preferably will, contain various optional components. Such optional components may be in either liquid or solid forrn. The optional components may either dissolve in the liquid phase or may be dispersed within the liquid phase in the form of fine particles or droplets. Some of the materials which may optionally be utilized in the compositions herein are described in greater detail as follows:

Optional organic additives

The detergent compositions may contain an organic additive. A preferred organic additive is hydrogenated castor oil and its derivatives.

Hydrogenated castor oil is a commercially available commodity being sold, for example, in various grades under the trademark CASTORWAX.RTM. by NL Industries, Inc., Highstown, N.J. Other suitable hydrogenated castor oil derivatives are Thixcin R, Thixcin E, Thixatrol ST, Perchem R and Perchem ST. Especially preferred hydrogenated castor oil is Thixatrol ST.

The castor oil can be added as a mixture with, for example stereamide.

The organic additive will be partially dissolved in the non-aqueous liquid diluent. To form the structured liquid phase required for suitable phase stability and acceptable rheology, the organic additive is generally present to the extent of from about 0.05% to 20% by weight of the liquid phase. More preferably, the organic additive will comprise from about 0.1% to 10% by weight of the non-aqueous liquid phase of the compositions herein.

Optional Inorganic Detergent Builders

The detergent compositions herein may also optionally contain one or more types of inorganic detergent builders beyond those listed hereinbefore that also function as alkalinity sources. Such optional inorganic builders can include, for example, aluminosilicates such as zeolites. Aluminosilicate zeolites, and their use as detergent builders are more fully discussed in Corkill et al., U.S. Pat. No. 4,605,509; Issued Aug. 12, 1986, the disclosure of which is incorporated herein by reference. Also crystalline layered silicates, such as those discussed in this '509 U.S. patent, are also suitable for use in the detergent compositions herein. If utilized, optional inorganic detergent builders can comprise from about 2% to 15% by weight of the compositions herein.

Optional Enzymes

The detergent compositions herein may also optionally contain one or more types of detergent enzymes. Such enzymes can include proteases, amylases, cellulases and lipases. Such materials are known in the art and are commercially available. They may be incorporated into the non-aqueous liquid detergent compositions herein in the form of suspensions, "marumes" or "prills". Another suitable type of enzyme comprises those in the form of slurries of enzymes in nonionic surfactants. Enzymes in this form have been commercially marketed, for example, by Novo Nordisk under the tradename "LDP."

Enzymes added to the compositions herein in the form of conventional enzyme prills are especially preferred for use herein. Such prills will generally range in size from about 100 to 1,000 microns, more preferably from about 200 to 800 microns and will be suspended throughout the non-aqueous liquid phase of the composition. Prills in the compositions of the present invention have been found, in comparison with other enzyme forms, to exhibit especially desirable enzyme stability in terms of retention of enzymatic activity over time. Thus, compositions which utilize enzyme prills need not contain conventional enzyme stabilizing such as must frequently be used when enzymes are incorporated into aqueous liquid detergents.

If employed, enzymes will normally be incorporated into the non-aqueous liquid compositions herein at levels sufficient to provide up to about 10 mg by weight, more typically from about 0.01 mg to about 5 mg, of active enzyme per gram of the composition. Stated otherwise, the non-aqueous liquid detergent compositions herein will typically comprise from about 0.001% to 5%, preferably from about 0.01% to 1% by weight, of a commercial enzyme preparation. Protease enzymes, for example, are usually present in such commercial preparations at levels sufficient to provide from 0.005 to 0.1 Anson units (AU) of activity per gram of composition.

Optional Chelating Agents

The detergent compositions herein may also optionally contain a chelating agent which serves to chelate metal i ons, e.g., iron and/or manganese, within the non-aqueous detergent compositions herein. Such chelating agents thus serve to form complexes with metal impurities in the composition which would otherwise tend to deactivate composition components such as the peroxygen bleaching agent. Useful chelating agents can include amino carboxylates, phosphonates, amino phosphonates, polyfunctionally-substituted aromatic chelating agents and mixtures thereof.

Amino carboxylates useful as optional chelating agents include ethylenediaminetetraacetates, N-hydroxyethylethylene-diaminetriacetates, nitrilotriacetates, ethylenediamine tetrapropionates, triethylenetetraamine-hexacetates, diethylenetriaminepentaacetates, ethylenediaminedisuccinates and ethanoldiglycines. The alkali metal salts of these materials are preferred.

Amino phosphonates are also suitable for use as chelating agents in the compositions of this invention when at least low levels of total phosphorus are permitted in detergent compositions, and include ethylenediaminetetrakis (methylene-phosphonates) as DEQUEST. Preferably, these amino phosphonates do not contain alkyl or alkenyl groups with more than about 6 carbon atoms.

Preferred chelating agents include hydroxyethyldiphosphonic acid (HEDP), diethylene triamine penta acetic acid (DTPA), ethylenediamine disuccinic acid (EDDS) and dipicolinic acid (DPA) and salts thereof. The chelating agent may, of course, also act as a detergent builder during use of the compositions herein for fabric laundering/bleaching. The chelating agent, if employed, can comprise from about 0.1% to 4% by weight of the compositions herein. More preferably, the chelating agent will comprise from about 0.2% to 2% by weight of the detergent compositions herein.

Optional Thickening, Viscosity Control and/or Dispersing Agents

The detergent compositions herein may also optionally contain a polymeric material which serves to enhance the ability of the composition to maintain its solid particulate components in suspension. Such materials may thus act as thickeners, viscosity control agents and/or dispersing agents. Such materials are frequently polymeric polycarboxylates but can include other polymeric materials such as polyvinylpyrrolidone (PVP) and polymeric amine derivatives such as quaternized, ethoxylated hexamethylene diamines.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight of the polymer.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000, and most preferably from about 4,000 to 5,000. Water-soluble salts of such acrylic acid polymers can include, for example, the alkali metal, salts. Soluble polymers of this type are known materials. Use of polyacrylates of this type in detergent compositions has been disclosed, for example, Diehl, U.S. Pat. No. 3,308,067, issued Mar. 7, 1967. Such materials may also perform a builder function.

If utilized, the optional thickening, viscosity control and/or dispersing agents should be present in the compositions herein to the extent of from about 0.1% to 4% by weight. More preferably, such materials can comprise from about 0.5% to 2% by weight of the detergents compositions herein.

Optional Brighteners, Suds Suppressors and/or Perfumes

The detergent compositions herein may also optionally contain conventional brighteners, suds suppressors, silicone oils, bleach catalysts, and/or perfume materials. Such brighteners, suds suppressors, silicone oils, bleach catalysts, and perfumes must, of course, be compatible and non-reactive with the other composition components in a non-aqueous environment. If present, brighteners, suds suppressors and/or perfumes will typically comprise from about 0.01% to 5% by weight of the compositions herein.

Suitable bleach catalysts include the manganese based complexes disclosed in U.S. Pat. Nos. 5,246,621, 5,244,594, 5,114,606 and 5,114,611. Especially preferred catalysts are the metallo-catalysts as described in co-pending U.S. patent applications Ser. Nos. 60/040,629, 60/039,915, 60/040,222, 60/040,156, 60/040,115, 60/038,714, 60/039,920, filed on Mar. 7, 1997.

COMPOSITION FORM

The particulate-containing liquid detergent compositions of this invention are substantially non-aqueous (or anhydrous) in character. While very small amounts of water may be incorporated into such compositions as an impurity in the essential or optional components, the amount of water should in no event exceed about 5% by weight of the compositions herein. More preferably, water content of the non-aqueous detergent compositions herein will comprise less than about 1% by weight.

The particulate-containing non-aqueous detergent compositions herein will be in the form of a liquid.

COMPOSITION PREPARATION AND USE

The non-aqueous liquid detergent compositions herein can be prepared by mixing non-aqueous liquid phase and by thereafter adding to this phase the additional particulate components in any convenient order and by mixing, e.g., agitating, the resulting component combination to form the stable compositions herein. In a typical process for preparing such compositions, essential and certain preferred optional components will be combined in a particular order and under certain conditions.

In a first step of a preferred preparation process, the anionic surfactant-containing liquid phase is prepared. This preparation step involves the formation of an aqueous slurry containing from about 30 to 60% of one or more alkali metal salts of linear C10–16 alkyl benzene sulfonic acid and from about 2–15% of one or more diluent non-surfactant salts. In a subsequent step, this slurry is dried to the extent necessary to form a solid material containing less than about 4% by weight of residual water.

After preparation of this solid anionic surfactant-containing material, this material can be combined with one or more of the non-aqueous organic diluents to form the surfactant-containing liquid phase of the detergent compositions herein. This is done by reducing the anionic surfactant-containing material formed in the previously described pre-preparation step to powdered form and by combining such powdered material with an agitated liquid medium comprising one or more of the non-aqueous organic diluents, either surfactant or non-surfactant or both as herein before described. This combination is carried out under agitation conditions which are sufficient to form a thoroughly mixed dispersion of particles of the insoluble fraction of the co-dried LAS/salt material throughout a non-aqueous organic liquid diluent.

In a subsequent processing step, particulate material to be used in the detergent compositions herein can be added. Such components which can be added under high shear agitation include any optional surfactant particles, particles of substantially all of an organic builder, e.g. citrate and/or fatty acid and/or alkalinity source, e.g. sodium carbonate, can be added while continuing to maintain this admixture of composition components is under shear agitation. Agitation of the mixture is continued, and if necessary, can be increased at this point to form a uniform dispersion of insoluble solid phase particulates within the liquid phase.

The non-aqueous liquid dispersion so prepared can be subjected to milling or high shear agitation. Milling conditions will generally include maintenance of a temperature between about 10 and 90° C., preferably between 20° C. and 60° C. Suitable equipment for this purpose includes: stirred ball mills, co-ball mills (Fryma), colloid mills, high pressure homogenizers, high shear mixers, and the like. The colloid mill and high shear mixers are preferred for their high throughput and low capital and maintenance costs. The small particles produced in such equipment will generally range in size from 0.4–150 microns.

Agitation is then continued, and if necessary, can be increased at this point to form a uniform dispersion of insoluble solid phase particles within the liquid phase.

In a second process step, the bleach precursor particles are mixed with the ground suspension from the first mixing step in a second mixing step. This mixture is then subjected to wet grinding so that the average particle size of the bleach precursor is less than 600 microns, preferably between 50 and 500 microns, most preferred between 100 and 400 microns.

After some or all of the foregoing solid materials have been added to this agitated mixture, the particles of the highly preferred peroxygen bleaching agent can be added to the composition, again while the mixture is maintained under shear agitation.

In a third processing step, the activation of the organic additive is obtained. The organic additives are subjected to wetting and dispersion forces to reach a dispersed state. It is well within the ability of a skilled person to activate the organic additive. The activation can be done according to that described by Rheox, in Rheology Handbook, A practical guide to rheological additives. There are basically three distinct stages. The first stage consists in adding the agglomerated powder in the solvent. This combination is carried out under agitation conditions (shear, heat, Stage 2) which are sufficient to lead to complete deagglomeration. With continued shear and heat development over a period of time, the solvent-swollen particles of the organic additive are reduced to their active state in stage 3.

In adding solid components to non-aqueous liquids in accordance with the foregoing procedure, it is advantageous to maintain the free, unbound moisture content of these solid materials below certain limits. Free moisture in such solid materials is frequently present at levels of 0.8% or greater (see method described below). By reducing free moisture content, e.g. by fluid bed drying, of solid particulate materials to a free moisture level of 0.5% or lower prior to their incorporation into the detergent composition matrix, significantly stability advantages for the resulting composition can be realized.

Free and Total Water Determinations:

For the purpose of this patent application, and without wanting to be bound by theory, we refer to "free water" as the amount of water that can be detected after removal of the solid, undissolved components of the product, whereas "total water" is referred to as the amount of water that is present in the product as a whole, be it bound to solids (e.g. water of hydration), dissolved in the liquid phase, or in any other form. A preferred method of water determinations is the so-called "Karl Fischer titration". Other methods than Karl Fischer titration, e. g. NMR, microwave, or IR spectroscopy, may also be suited for the determination of water in the liquid part of the product and in the full product as described below.

The "free water" of a formulation is determined in the following way. At least one day after preparation of the formula (to allow for equilibration), a sample is centrifuged until a visually clear layer, free of solid components, is obtained. This clear layer is separated from the solids, and a weighed sample is directly introduced into a coulometric Karl Fischer titration vessel. The water level determined in this way (mg water/kg clear layer) is referred to as "free water" (in ppm).

The "total water" is determined by first extracting a weighed amount of finished product with an anhydrous, polar extraction liquid. The extraction liquid is selected in such a way that interferences from dissolved solids are minimized. In most cases, dry methanol is a preferred extraction liquid. Usually, the extraction process reaches an equilibrium within a few hours—this needs to be validated for different formulations—and can be accelerated by sonification (ultrasonic bath). After that time, a sample of the extract is centrifuged or filtered to remove the solids, and a known aliqot then introduced into the (coulometric or volumetric) Karl Fischer titration cell. The value found in this way (mg water/kg product) is referred to as "total water" of the formulation.

Viscosity and yield measurements:

The particulate-containing non-aqueous liquid detergent compositions herein will be relatively viscous and phase stable under conditions of commercial marketing and use of such compositions. Frequently, the viscosity of the compositions herein will range from about 300 to 10,000 cps, more preferably from about 500 to 3000 cps. The physical stability of such formulations can also be determined by yield measurements. Frequently, the yield of the compositions herein will range from about 1 to 20 Pa, more preferably from about 1.5 to 10 Pa. For the purpose of this invention, viscosity and yield are measured with a Carri-Med $CSL^2$ 100 rheometer according to the method described herein below.

Rheological properties were determined by means of a constant stress rheometer (Carri-Med $CSL^2$100) at 25° C. A parallel-plate configuration with a disk radius of 40 mm and a layer thickness of 2 mm was used. The shear stress was varied between 0.1 Pa and 125 Pa. The reported viscosity was the value measured at a shear rate of about 20 $s^{-1}$. Yield stress was defined as the stress above which motion of the disk was detected. This implies that the shear rate was below $3\times10^{-4}$ $s^{-1}$.

Gas evolution rate measurements:

Gas evolution rates (GERs) can be measured by placing a product sample (usually 1000–1200 g) in an Erlenmeyer which can be closed gas tight by means of an adapter and a valve. The product is then stored at a constant temperature (usually 35° C.), and connected to a gas burette. After a certain time (usually 1–10 days), the valve is opened and the volume difference is measured. To minimize effects of ambient pressure changes, the values are referenced versus a sample that does not contain bleach. In general, the GER of the non-aqueous liquid detergent compositions containing Y % of a bleaching agent, said bleaching agent having a GER of Z mL/day/kg product at 35° C., should be less than 0.008 Y×Z mL/day/kg product at 35° C.

The compositions of this invention, prepared as herein before described, can be used to form aqueous washing solutions for use in the laundering and bleaching of fabrics. Generally, an effective amount of such compositions is added to water, preferably in a conventional fabric laundering automatic washing machine, to form such aqueous laundering/bleaching solutions. The aqueous washing/bleaching solution so formed is then contacted, preferably under agitation, with the fabrics to be laundered and bleached therewith.

An effective amount of the liquid detergent compositions herein added to water to form aqueous laundering/bleaching solutions can comprise amounts sufficient to form from about 500 to 8,000 ppm of composition in aqueous solution. More preferably, from about 800 to 5,000 ppm of the detergent compositions herein will be provided in aqueous washing/bleaching solution.

The following examples illustrate the preparation and performance advantages of non-aqueous liquid detergent compositions of the instant invention. Such examples, however, are not necessarily meant to limit or otherwise define the scope of the invention herein.

EXAMPLE I

Preparation of Non-Aqueous Liquid Detergent Composition

1) Part of the Butoxy-propoxy-propanol (BPP) and a $C_{11}$EO (5) ethoxylated alcohol nonionic surfactant (Genapol 24/50) are mixed for a short time (1–5 minutes) using a blade impeller in a mix tank into a single phase.
2) LAS is added to the BPP/NI mixture after heating the BPP/NI mixture up to 45° C.
3) If needed, liquid base (LAS/BPP/NI) is pumped out into drums. Molecular sieves (type 3A, 4–8 mesh) are added to each drum at 10% of the net weight of the liquid base. The molecular sieves are mixed into the liquid base using both single blade turbine mixers and drum rolling techniques. The mixing is done under nitrogen blanket to prevent moisture pickup from the air. Total mix time is 2 hours, after which 0.1–0.4% of the moisture in the liquid base is removed. Molecular sieves are removed by passing the liquid base through a 20–30 mesh screen. Liquid base is returned to the mix tank.
4) Additional solid ingredients are prepared for addition to the composition. Such solid ingredients include the following:

Sodium carbonate (particle size 100 microns)

Sodium citrate dihydrate

Maleic-acrylic copolymer (BASF Sokolan)

Brightener (Tinopal PLC)

Tetra sodium salt of hydroxyethylidene diphosphonic acid (HEDP)

Sodium diethylene triamine penta methylene phosphonate

Ethylenediamine disuccinic acid (EDDS)

These solid materials, which are all millable, are added to the mix tank and mixed with the liquid base until smooth. This approximately takes 1 hour after addition of the last powder. The tank is blanketed with nitrogen after addition of the powders. No particular order of addition for these powders is critical.

5) The batch is pumped once through a Fryma colloid mill, which is a simple rotor-stator configuration in which a high-speed rotor spins inside a stator which creates a zone of high shear. This reduces particle size of all of the solids. This leads to an increase in yield value (i.e. structure). The batch is then recharged to the mix tank after cooling.

6) The bleach precursor particles are mixed with the ground suspension from the first mixing step in a second mixing step. This mixture is then subjected to wet grinding so that the average particle size of the bleach precursor is less than 600 microns, preferably between 50 and 500 microns, most preferred between 100 and 400 microns.

7) Other solid materials could be added after these first processing steps.

These include the following:

Sodium percarbonate (400–600 microns)

Protease, cellulase and amylase enzyme prills (400–800 microns, specific density below 1.7 g/mL)

Titanium dioxide particles (5 microns)

Catalyst

These non-millable solid materials are then added to the mix tank followed by liquid ingredients (perfume and silicone-based suds suppressor fatty acid/silicone). The batch is then mixed for one hour (under nitrogen blanket).

8) As a final step to the formulation, hydrogenated castor oil is added to part of the BPP in a colloid mill at high speed. the dispersion is heated to 55° C. Shear time is approximately one hour.

The resulting composition has the formula set forth in Table I.

The catalyst is prepared by adding an octenylsuccinate modified starch, to water in the approximate ratio of 1:2. Then, the catalyst is added to the solution and mixed to dissolve. The composition of the solution is:

| | |
|---|---|
| catalyst | 5% |
| starch | 32% (the starch includes 4–6% bound water) |
| water | 63% |

The solution is then spray dried using a lab scale Niro Atomizer spray drier. The inlet of the spray drier is set at 200° C., and the atomizing air is approximately 4 bar. The process air pressure drop is roughly 30–35 mm water. The solution feed rate is set to get an outlet temperature of 100° C. The powdered material is collected at the base of the spray drier.

The composition is:

| | |
|---|---|
| catalyst | 15% |
| starch (and bound water) | 85% |

The particle size is 15 to 100 um exiting the dryer.

TABLE I

Non-Aqueous Liquid Detergent Composition with Bleach

| Component | Wt % Active | Wt % Active |
|---|---|---|
| LAS Na Salt | 16 | 15 |
| C11E0 = 5 alcohol ethoxylate | 21 | 20 |
| BPP | 19 | 19 |
| Sodium citrate | 4 | 5 |
| [4-[N-nonanoyl-6-aminohexanoyloxy] benzene sulfonate] Na salt | 6 | 7 |
| Chloride salt of methyl quarternized polyethoxylated hexamethylene diamine | 1.2 | 1 |
| Ethylenediamine disuccinic acid | 1 | 1 |
| Sodium Carbonate | 7 | 7 |
| Maleic-acrylic copolymer | 3 | 3 |
| Protease Prills | 0.40 | 0.4 |
| Amylase Prills | 0.8 | 0.8 |
| Cellulase Prills | 0.50 | 0.5 |
| Sodium Percarbonate | 16 | — |
| Sodium Perborate | — | 15 |
| Suds Suppressor | 1.5 | 1.5 |
| Perfume | 0.5 | 0.5 |
| Titanium Dioxide | 0.5 | 0.5 |
| Brightener | 0.14 | 0.2 |
| Thixatrol ST | 0.1 | 0.1 |
| Speckles | 0.4 | 0.4 |
| Miscellaneous up to 100% | | |

The resulting Table I composition is a stable anhydrous heavy-duty liquid laundry detergent which provides excellent stain and soil removal performance when used in normal fabric laundering operations. The GER is less than 0.35 mL/day/kg at 35° C. The chemical decomposition of the perborate and bleach precursor was insignificant even after 6 weeks of storage at room temperature.

What is claimed is:

1. A non-aqueous liquid detergent composition comprising a bleaching agent and a bleach precursor wherein the free water content of the non-aqueous liquid detergent composition is then 0.7% and comprising a bleaching agent and a bleach precursor wherein the free water content of the non-aqueous liquid detergent composition is less than 0.7% and wherein the gas evolution rate of the non-aqueous liquid detergent composition containing Y of a bleaching agent, said bleaching agent having a GER of Z mL/day/kg product at 35° C., is less than 0.008 Y×Z mL/day/kg product at 35° C.

2. A non-aqueous liquid detergent composition according to claim 1 wherein the bleaching agent is selected from percarbonate and/or perborate or mixtures thereof.

3. A non-aqueous liquid detergent composition according to claims 1 wherein said bleach precursor is selected from (6-octanamido-caproyl)oxybenzenesulfonate, (6-nonanamidocaproyl)oxy benzene sulfonate, (6-decanamido-caproyl)oxybenzenesulfonate, and mixtures thereof.

* * * * *